United States Patent [19]

Boltrek

[11] Patent Number: 4,535,880

[45] Date of Patent: Aug. 20, 1985

[54] ESCALATOR

[75] Inventor: Henry Boltrek, Freeport, N.Y.

[73] Assignee: Westinghouse Electric Corp., Pittsburgh, Pa.

[21] Appl. No.: 532,437

[22] Filed: Sep. 15, 1983

[51] Int. Cl.[3] ..... B65B 9/12; B65B 9/14

[52] U.S. Cl. ..... 198/330; 198/331

[58] Field of Search ..... 198/330, 331, 326, 322, 198/321; 248/660, 661, 662

[56] References Cited

U.S. PATENT DOCUMENTS

| | | | |
|---|---|---|---|
| 785,882 | 3/1905 | Hocquart | 198/331 |
| 898,009 | 9/1908 | Seeberger | 198/330 |
| 3,677,388 | 7/1972 | Boltrek et al. | 198/330 |
| 4,148,453 | 4/1979 | Brantly | 248/660 |

FOREIGN PATENT DOCUMENTS

| | | | |
|---|---|---|---|
| 77278 | 3/1954 | Denmark | 248/661 |
| 650775 | 2/1929 | France | 248/662 |
| 288929 | 9/1931 | Italy | 248/660 |

*Primary Examiner*—Joseph E. Valenza
*Assistant Examiner*—Daniel R. Alexander
*Attorney, Agent, or Firm*—Donald R. Lackey

[57] ABSTRACT

An escalator having a drive unit mounted in a supporting truss via a deflection beam. Load forces developed in the drive unit are transmitted from the drive unit to the ends of the deflection beam via elongated mounting base members which are not subjected to bending moments sufficient to cause harmful deflection and misalignment of the driving and rotating elements of the drive unit. The midpoint of a deflection beam is attached to the truss. Positioning devices adjustably orient the drive unit in the truss, and the midpoint connection of the drive unit to the truss adjustably selects the position of the drive unit along the longitudinal axis of the truss.

8 Claims, 6 Drawing Figures

ESCALATOR

BACKGROUND OF THE INVENTION

1. Field of the Invention:

The invention relates in general to escalators, and more specifically to escalators which have one or more drive units mounted in a supporting truss for engagement with a conveyor unit which carries escalator steps.

2. Description of the Prior Art:

U.S. Pat. Nos. 3,677,388; 3,682,289 and 3,707,220, all assigned to the same assignee as the present application, disclose new and improved passenger conveyor apparatus, such as escalators, in which the steps are pulled up the incline by toothed step links. A modular drive unit located in the truss, between the load bearing and return runs, just below the transition between the inclined portion and the upper horizontal portion of the escalator, includes a drive chain which engages toothed step links on an endless belt, on both the upper load bearing run and the lower return run. Additional drive units are added to the inclined portion, as required by the total rise.

The endless belt includes two sides, each of which are formed by pivotally interconnected, toothed step links. Step axles interconnect the two sides of the endless belt, and the steps are clamped to the step axles. The endless belt and steps are guided through the load bearing and return runs, as well as through the turnarounds which interconnect the load bearing and return runs, by axle rollers or guide wheels on the ends of the step axles, trailer wheels on the steps, and separate guide tracks for supporting the guide wheels and the trailer wheels.

The escalator construction of the hereinbefore mentioned patents provides many advantages over escalators which utilize a step chain and a top sprocket-drive machine to pull the steps up the incline. One of the most significant advantages is a substantial reduction in load on the working parts. As the length of the rise increases, the load on the parts remains low, with additional modular drive units being added to the incline, as required. The rigid step links maintain a constant distance between the step axles, eliminating the need for tensioning devices, which are required with the step chain construction.

For minimal wear of the drive chains, and proper load sharing between multiple drive units, each drive unit must be correctly aligned with the conveyor, and multiple drive units must be correctly spaced. If the axis of the drive unit which is oriented in the direction of the step travel direction is called the X-axis, the transverse axis is called the Y-axis, and the axis transverse to the plane which includes the X- and Y- axes is the Z-axis, each drive unit must be correctly oriented about its X-, Y-, and Z-axes such that the X-axis of the drive unit is parallel with the longitudinal axis of the supporting truss, and the toothed links on each side of the endless belt or conveyor make like contact with drive chains located on each side of the drive unit. Each drive unit must be adjustable in the direction of its Z-axis to provide the desired tooth-drive chain contact, and in the direction of its X-axis to properly engage the toothed links with the drive chain across the load range. The latter adjustment is especially important when more than one drive unit is used to drive the conveyor, as it is this adjustment which causes the drive units to properly share the load across the load range. Co-pending Application Ser. No. 292,974, filed Sept. 14, 1981, entitled "Method of And Apparatus for Positioning the Drive Units of a Plural Drive Escalator", now U.S. Pat. 4,397,096, which is assigned to the same assignee as the present application, describes the importance of precise drive spacing in more detail.

Thus, it is desirable to be able to quickly and accurately position each drive unit in the truss.

In addition to being able to quickly and easily select the desired drive position, it is important that the selected position be maintained as the drive unit is loaded. The toothed link-drive chain interface introduces forces into the drive sprockets which transfer the forces through the drive mounting frame or base to the supporting truss. These forces can cause bending moments to be applied to various elements of the drive mounting base, causing harmful deflection and misalignment of the driving and rotating elements of the drive unit. Thus, it would be desirable to provide a drive unit-truss construction which minimizes deflection of these critical elements of the drive unit.

SUMMARY OF THE INVENTION

Briefly, the invention is a new and improved escalator having a supporting truss, and one or more drive units mounted in the truss. The drive units are each positionally adjustable as a unit in the truss. Each drive unit includes a rigid frame constructed of side and cross channel members, with load forces developed in the drive unit being transmitted to the truss via the rigid side channel members, and by a deflection beam or channel which is spaced from a cross channel and connected to the rigid side channel members. The drive forces are applied to the ends of the deflection channel. The midpoint of the deflection channel is adjustably fixed to the truss via a stud which allows the position of the entire drive unit to be adjusted, in the direction of the longitudinal axis of the truss, and to be fixed in the selected position. Additional adjustment points allow selectable adjustment of each drive unit relative to the truss, which adjustments are not changed when the drive unit is moved up or down the inclined truss via the stud-truss interface.

BRIEF DESCRIPTION OF THE DRAWINGS

The invention may be better understood and further advantages and uses thereof more readily apparent, when considered in view of the following detailed description of exemplary embodiments, taken with the accompanying drawings in which.

DESCRIPTION OF PREFERRED EMBODIMENTS

Figure 1:
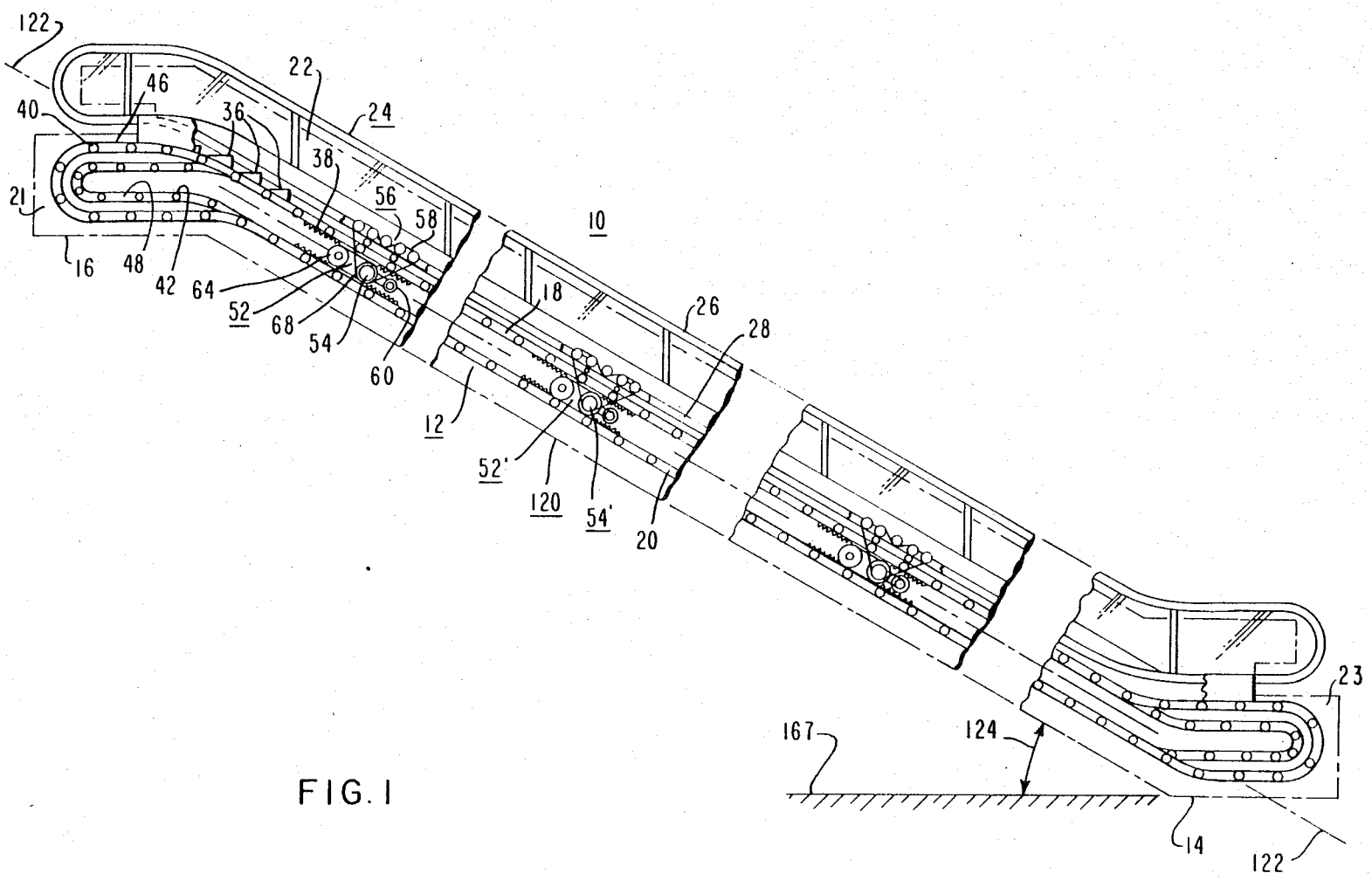
FIG. 1 is an elevational view of an escalator, which may be constructed according to the teachings of the invention.

Referring now to the drawings, and to FIG. 1 in particular, there is shown an escalator 10 of the type which may utilize the teachings of the invention. Escalator 10 employs a conveyor or endless belt 12, supported by a truss 120 for transporting passengers between a first or lower landing 14 and a second or upper landing 16. The conveyor 12 is of the endless type, having an upper load bearing run 18 on which passengers stand while being transported between the landings, a lower return run 20, and upper and lower turnarounds 21 and 23, respectively.

A balustrade 22 is disposed above the conveyor 12 for guiding a continuous flexible handrail 24. The balustrade guides the handrail 24 as it moves about a closed loop.

Conveyor 12 includes a plurality of steps 36, only a few of which are shown in FIG. 1. The steps are each clamped to a step axle 39 (FIG. 2), and they are driven in a closed path by a modular drive arrangement. The modular drive arrangement includes one or more modular drive units mounted in the truss incline, as disclosed in U.S. Pat. No. 3,677,388, which is assigned to the same assignee as the present application. U.S. Pat. No. 3,677,388 is hereby incorporated into the specification of the present application by reference.

As disclosed in detail in U.S. Pat. No. 3,677,388, the conveyor or endless belt 12 has first and second sides, with each side being formed of a plurality of toothed links 38, interconnected by the step axles 39 to which the steps 36 are connected. The belt 12 is supported by main wheels or rollers 40 disposed at opposite sides of the endless belt. The steps 36, in addition to being supported by belt 12, are also supported by trailer wheels or rollers 42. The main and trailer rollers 40 and 42 cooperate with main and trailer tracks 46 and 48, respectively, to support and guide the steps 36 in the endless path or loop, and to cause articulation of the steps between platform and step modes at the proper locations.

The steps are driven by one or more modular drive units, such as modular drive units 52 and 52'. Each modular drive unit 52 includes sprocket wheels and a drive chain for engaging the toothed links 38. The modular drive unit includes a handrail drive pulley 54 mounted on a shaft 88, on each side of the conveyor 12, which drives a handrail drive unit 56 via a drive chain or belt 58. The handrail drive unit 56 may be fixed to a suitable truss element, such as to main guide track 46, shown in FIG. 2, using suitable brackets 61 and 63. Handrail drive arrangements which may be used are shown in detail in U.S. Pat. Nos. 3,414,109 and 3,779,360, which are assigned to the same assignee as the present application.

Figure 2:
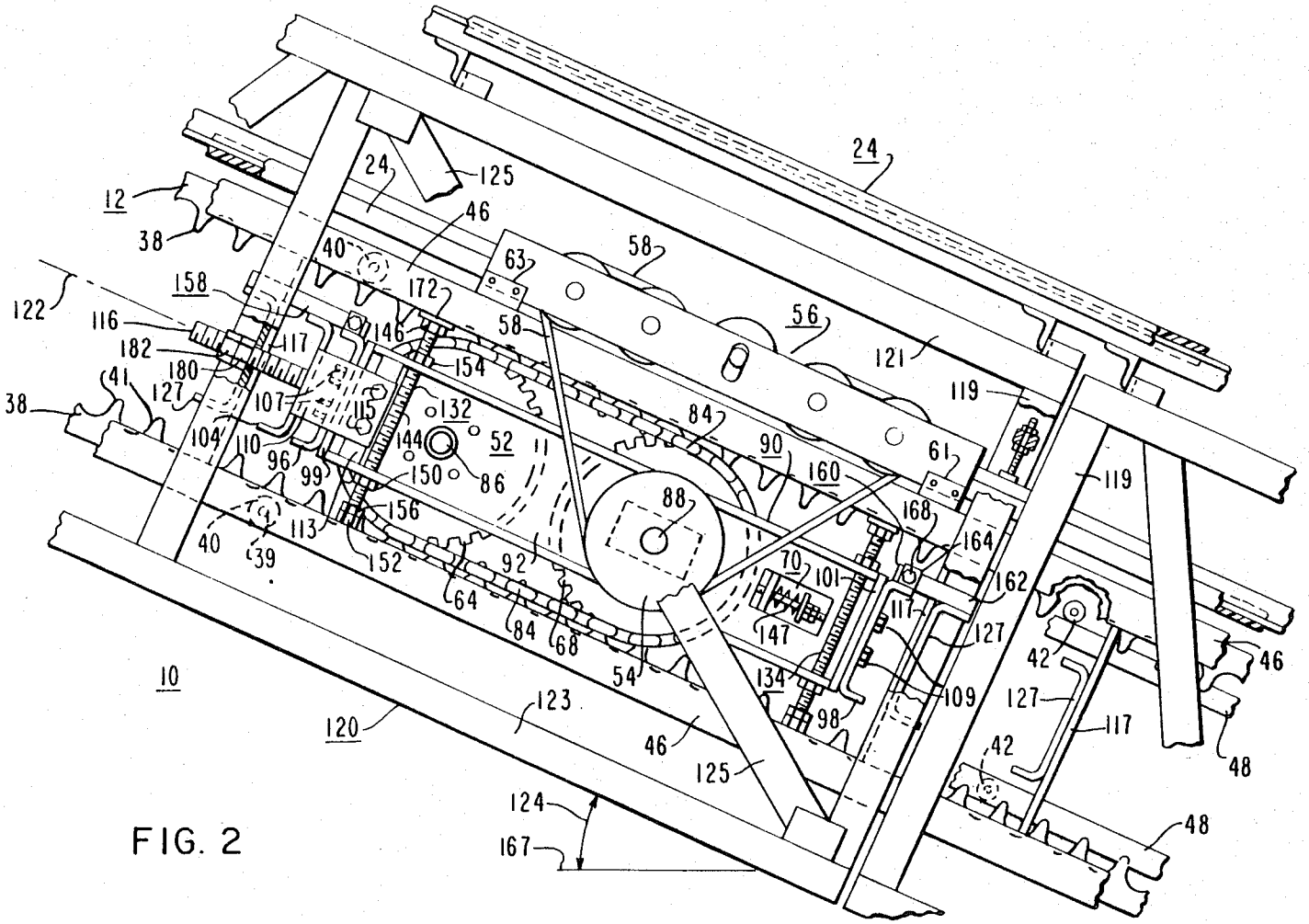
FIG. 2 is a side elevational view of a drive unit constructed according to the teachings of the invention, which may be used in the escalator shown in FIG. 1.
Figure 3:
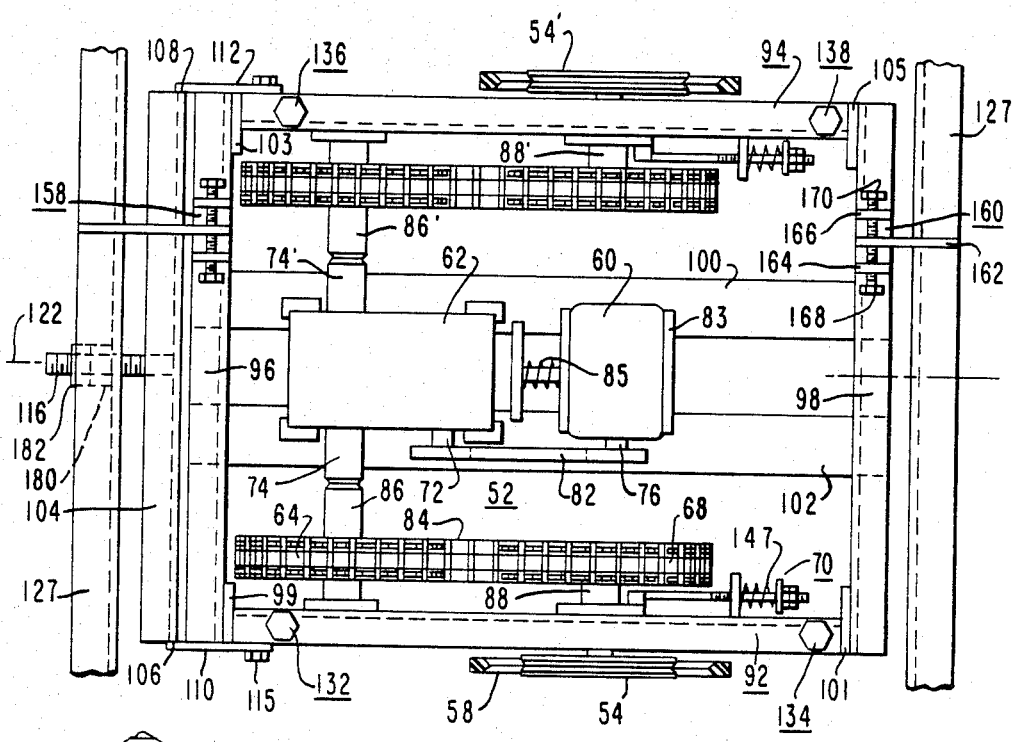
FIG. 3 is a plan view of the drive unit shown in FIG. 2.

FIG. 2 is an elevational view of an inclined section of truss 120 which includes a drive unit 52 constructed according to the teachings of the invention, which may be used for each of the drive units shown in FIG. 1. FIG. 3 is a plan view of the drive unit shown in FIG. 2.

Figure 4:
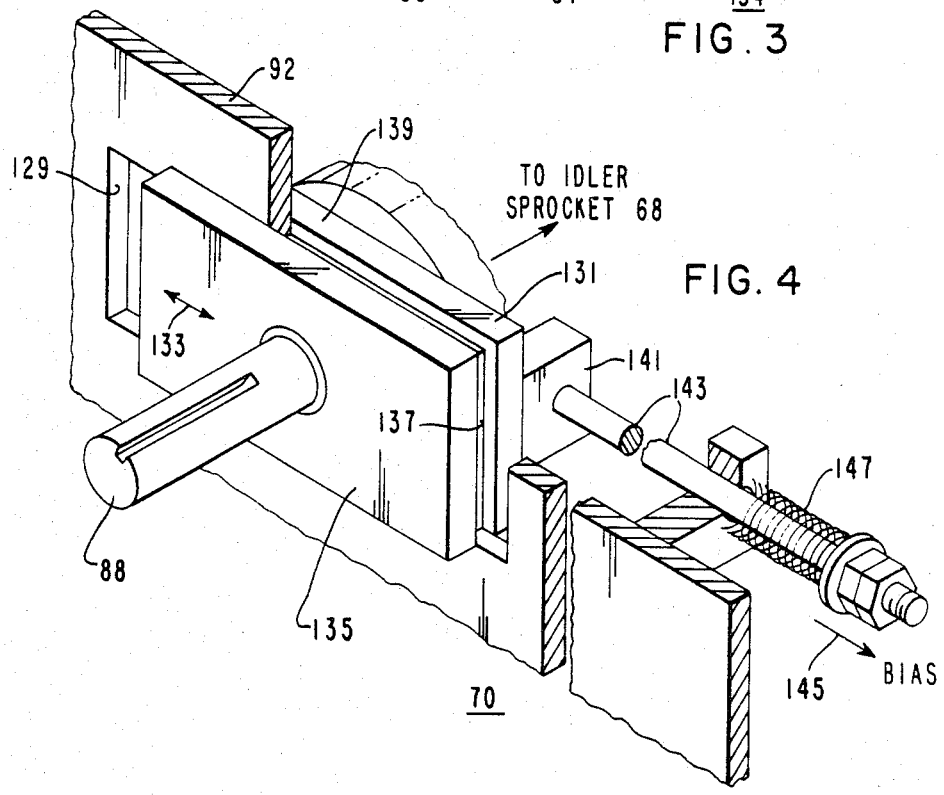
FIG. 4 is a fragmentary, perspective view setting forth an exemplary spring-mounting arrangement for the idler sprocket of the drive unit.

In general, as shown most clearly in FIG. 3, drive unit 52 includes an electrical drive motor 60, such as a three-phase, 60 Hz induction motor, a gear reducer 62, a pair of spaced, driven sprocket wheels, such as sprocket wheel 64, a pair of spaced idler sprocket wheels, such as sprocket wheel 68, and a pair of drive chains, such as drive chain 84, each of which engage a driven sprocket and an idler sprocket. Each idler sprocket 68 is spring loaded or biased, as shown in FIGS. 2, 3 and 4, to maintain the desired tension in the drive chain 84. A biasing arrangement 70, which may be used, is shown in detail in FIG. 4. The gear reducer 62, which may be a commerical gear reducer, has an input shaft 72 and output shafts 74 and 74'. The drive motor 60 has a motor shaft 76. The motor shaft 76 is coupled to the input shaft 72 of the gear reducer 62 by any suitable means, such as pulleys and a timing belt 82. The drive motor is mounted on a pad 83 biased by spring 85, which is arranged to produce and maintain a substantially constant tension in the timing belt 82.

The output shafts 74 and 74' of gear reducer 62 are connected to the spaced pair of driven sprockets via suitable drive shafts 86 and 86', and each driven sprocket is coupled with an idler sprocket via the drive chain 84. The drive chain 84, for example, may have three strands, with the two outer strands engaging teeth on the sprockets, and with the inner strand engaging teeth 41 on the toothed links 38, to drive the endless belt 12 about a guided loop.

Figure 5:
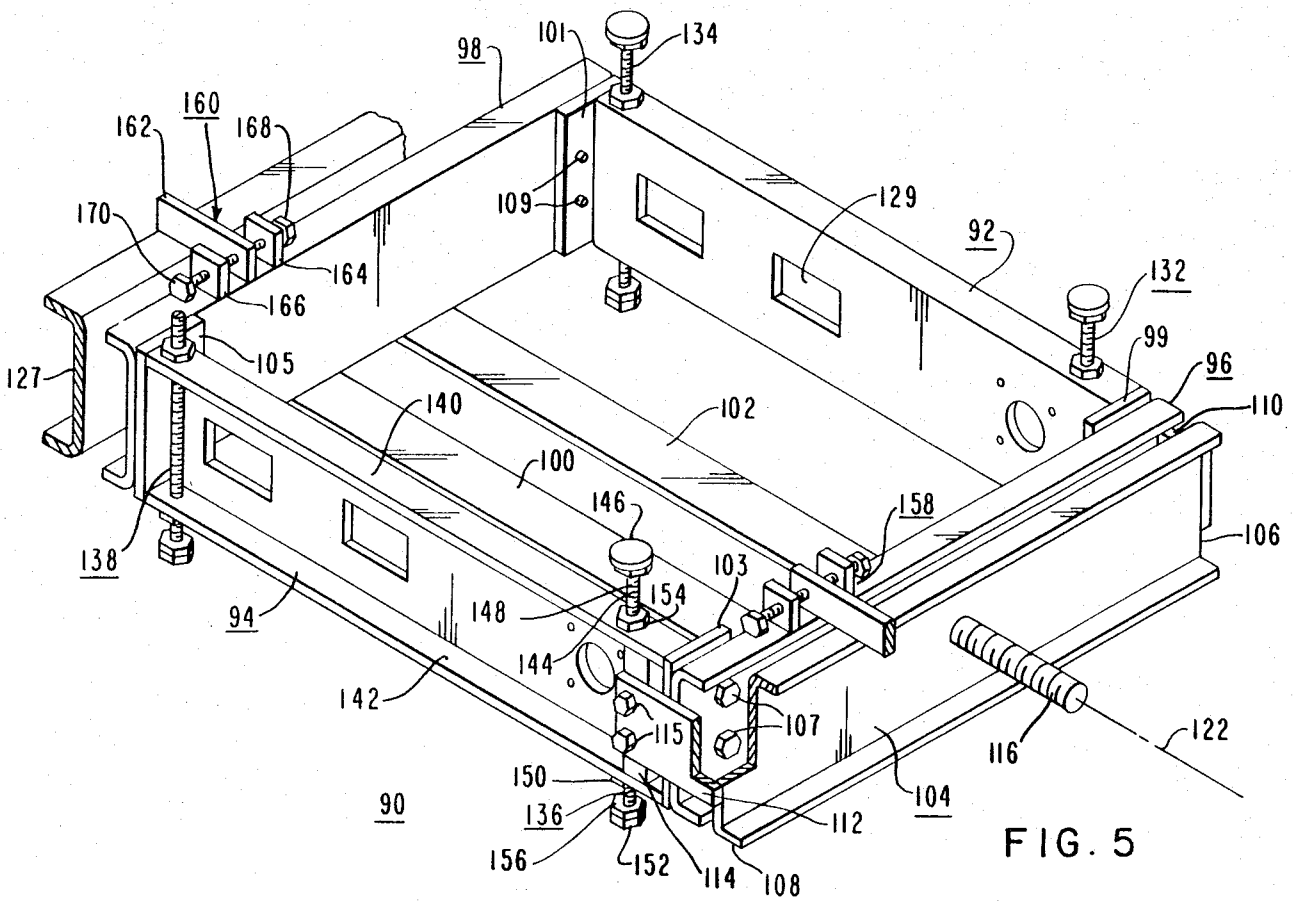
FIG. 5 is a perspective view of the mounting frame and base of the drive unit shown in FIGS. 2 and 3.

Drive unit 52 includes a sturdy, rigid, metallic mounting frame 90, best shown in FIG. 5, which is a perspective view of frame 90. Frame 90 includes first and second rigid side channel members 92 and 94, respectively, and front and rear rigid cross channel members 96 and 98, respectively. The adjacent ends of the side and cross channel members are secured together, such as by welding, to create a rectangular outer frame. For example, plate members 99 and 101 may be welded to the ends of side channel members 92, and plate members 103 and 105 may be welded to the ends of side channel member 94. Cross channel member 96 may then be fixed to plate members 99 and 103, such as via bolts 107, and cross channel member 98 may be fixed to plate members 101 and 105 via bolts 109. First and second bedplate members 100 and 102 are disposed to extend across the bottom of the rectangular outer frame structure, between the front and rear cross channel members 96 and 98. The drive motor 60 and gear reducer 62 are mounted on the bedplate members 100 and 102, with the drive motor being mounted on the bedplate members via the hereinbefore-mentioned spring loaded pad or base 83.

A deflection member or beam 104 is provided, which has first and second ends 106 and 108. Ends 106 and 108 of the deflection beam 104 are rigidly connected to the first and second side channel members 92 and 94, respectively, via mounting plate members 110 and 112. Members 110 and 112 may each have one end welded to the first and second ends 106 and 108 of the deflection beam 104, and their other ends are fixed to side channel members 92 and 94. For example, block members 113 and 114 may be welded between the flanges of the side channel members 92 and 94, respectively, and bolts 115 may be used to fix mounting plate members 110 and 112 to the block members 113 and 114. When deflection beam 104 is assembled with the outer frame 90, its major flat surfaces are in spaced parallel relation with the major flat surfaces of the front cross channel 96. A sturdy stud 116 is fixed to substantially the midpoint of the deflection beam 104. For example, one end of stud 116 may be welded to beam 104, or beam 104 may have an opening sized to receive stud 116, and nuts may be engaged with stud 116 to secure it to beam 104. Stud 116 connects the drive unit 52 to the truss or main support 120 of the escalator via nuts 180 and 182, best shown in FIG. 2.

As explained in detail in U.S. Pat. No. 3,707,220, which is assigned to the same assignee as the present application, truss 120 is preferably formed of a plurality of modules, with FIG. 2 setting forth an exemplary embodiment of a drive unit module. Construction of a module begins with the fabrication of right and left hand sections. For each of such half sections, upper and lower channel-shaped main tracks 46, and upper and lower angle-shaped trailer tracks 48 are precisely aligned with respect to one another through rigid connection to a plurality of spaced, precision templates 117. The four track sections, when held in rigid alignment by the templates 117, form track assemblies.

The half sections are completed by welding truss pieces to the track assemblies. Vertical truss members 119 are welded to alternate templates 117. Upper longitudinal truss members 121 and lower longitudinal truss members 123 are then welded to the ends of the vertical truss members 119. Added rigidity is given to the structure by diagonal truss members 125 which are welded to the upper and lower longitudinal truss members 121 and 123, respectively.

The right and left hand sections are then joined by boxing channel members 127, which are welded to predetermined templates 117.

In addition of fixing the drive unit 52 to the truss 120, the stud 116 functions as a single adjustment point for moving the drive unit 52 along the incline. Truss 120 has a longitudinal axis 122 along its incline which forms a predetermined angle 124 with a horizontal plane 167. The drive unit 52 has a longitudinal axis to be aligned with axis 122, which axis is the same as the longitudinal axis of the stud 116. When the drive unit 52 is properly mounted in the truss 120, the respective longitudinal axes coincide with one another. Thus, the drive sprockets 64 are fixed to the mounting frame 90, and the whole mounting frame is positionally adjusted for optimum location and performance.

The idler sprockets 68 are spring biased to achieve and maintain desired drive chain tension. FIG. 4 is a fragmentary, perspective view setting forth an exemplary biasing arrangement 70 which may be used for each idler sprocket. More specifically, FIG. 4 illustrates a rectangular opening 129 formed in the web of side channel member 92, with an assembly 131 disposed to slide back and forth in the opening 129, in the direction of longitudinal axis 122, as indicated by double-headed arrow 133. Assembly 131 includes first, second and third plate members 135, 137 and 139, respectively, and a shaft, which may be the handrail drive pulley shaft 88. Plate members 135 and 139 are similarly dimensioned, and are larger than opening 129. Plate member 137, which is disposed between the first and third plate members, has a smaller dimension, sized to snugly extend through opening 129. One end of shaft 88 is fixed to the idler sprocket 68, to be turned with rotation of the idler sprocket. A metallic block 141 is fixed to assembly 131, and a threaded shaft 143 is biased in the direction of arrow 145 by a compression spring 147 shown in FIG. 3.

Figure 6:
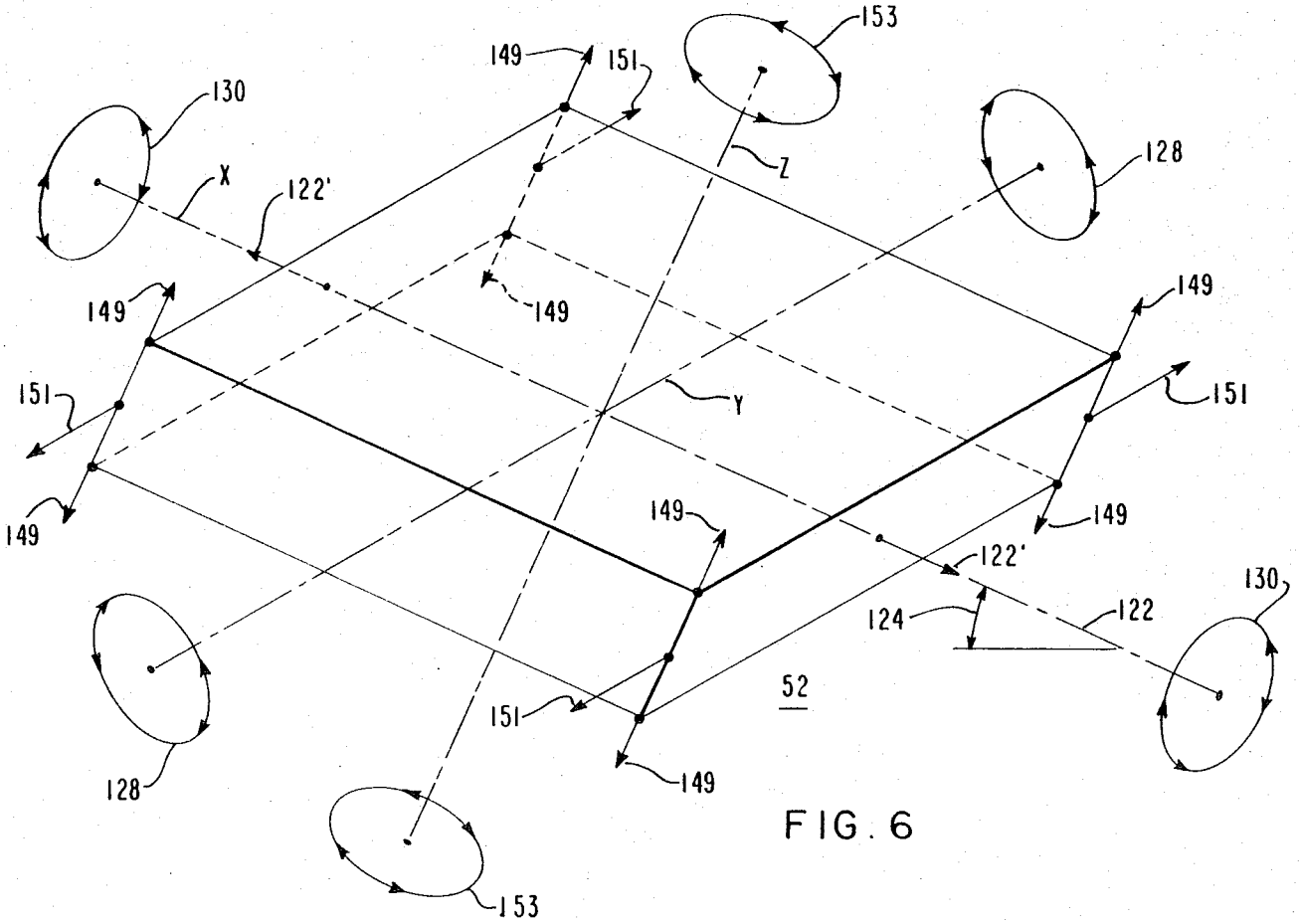
FIG. 6 is a general view of the drive unit of FIGS. 2 and 3, which sets forth the various mounting adjustments which may be made when the drive unit is installed in a truss.

If the positional adjustment provided by stud 116 is considered to be along an X-axis, mounting frame 90 would include a Y-axis which extends between side channels 92 and 94, transverse to the X-axis, and a Z-axis perpendicular to the plane which includes the X and Y axes. This relationship is diagrammatically set forth in FIG. 6, which illustrates the longitudinal or X-axis 122 is inclined from the horizontal by an angle 124, such as 30 degrees. Adjustment of the drive unit by stud 116, nut 180 and lock nut 182, provides positional adjustment relative to the truss 120 along the X axis, as indicated by arrows 122'.

Positional adjustment (a) along the Z-axis, indicated by double-headed arrows 149, (b) about the Y axis, indicated by circles 128, and (c) about the X-axis, indicated by circles 130, is provided by at least four adjustment devices. At least two of the adjustment devices, such as devices 132 and 134, are disposed on one side of longitudinal axis 122, and at least two, such as devices 136 and 138, are disposed on the other side. For example, as illustrated relative to device 136 in FIG. 5, the upper and lower flange portions 140 and 142, respectively, of side channel member 94 may have aligned openings for receiving a bolt 144 having a head portion 146 and a threaded shaft portion 148. The opening in flange 142 may be threaded, or a nut 150 may be welded to flange 142 adjacent to an opening. Positional adjustment is provided by tapped hex adapter 152. Lock nuts 154 and 156 secure the selected position. The bolt heads 146 may be welded to adapters 172, which contact the upper run of track 46. The hex adapter 152, contacts the lower run of the main guide track 46.

Adjustment, up or down, of the devices on the same side of the longitudinal axis, such as devices 132 and 134, or devices 136 and 138, provide rotational adjustment of frame 90 about its longitudinal or X-axis. Adjustment, up or down, of two devices located on opposite sides of longitudinal axis 122, such as devices 134 and 138, or devices 132 and 136, provides rotational adjustment of frame 90 about the Y-axis. Equal adjustment, up or down, of all four devices provides movement of frame 90 along the Z-axis, as indicated by arrows 149.

Adjustment of frame 90 (a) in the direction of it Y-axis, i.e., side-to-side or transverse, as indicated by arrows 151, and (b) rotational adjustment about its Z axis, indicated by circles 153, is provided by first and second adjustment devices 158 and 160, which are of like construction. For example, the second adjustment device 160 includes an elongated bar member 162 which is fixed to the boxing or cross channel member 127 of the truss. The longitudinal axis of bar member 162 is oriented parallel with the longitudinal axis 122. Adjustable device 162 further includes first and second spaced plate members 164 and 166, which are fixed to the top or upper flange of the back cross channel member 98 of the support frame 90, such that the elongated bar member 162 extends into the space between them. Tapped openings in each spaced plate member 164 and 166 receive adjustment screws 168 and 170, respectively. Adjustment screws 168 and 170 can be threadably adjusted to move frame 90 by backing one screw out and advancing the other to push against bar member 162. Then, by adjusting the non-contacting screw such that it contacts bar member 162, the selected position can be fixed. Equal adjustment of each adjustment device 158 and 160 in the same direction advances frame 90 along its Y-axis, as indicated by arrows 151. Equal adjustment of each device 158 and 160 in opposite directions rotates frame 90 about its Z-axis, as indicated by circles 153. Adjustment of only one device, such as device 158, rotates frame 90 about an axis which is parallel with X-axis, which axis passes between the facing ends of the adjustment screws of the other device, such as between the ends of the screws 168 and 170.

In summary, there has been disclosed a new and improved escalator having one or more drive units mounted in a support truss, with each drive unit being positionally adjusted relative to the truss as a complete unit. In other words, instead of adjusting the positions of the drive sprockets of the drive unit, the complete drive unit is adjusted in order to adjust the positions of the drive sprocket. Further, each drive unit is constructed such that load applied to the drive unit is transmitted to the truss without forming bending moments in the supporting frame structure 90 of the drive unit 52 sufficient to cause harmful deflection and misalignment of the driving and rotating elements of the drive unit 52. This result is achieved by a deflection beam which is spaced from a cross channel of the support frame of the drive unit, and connected to two side channels of the support frame.

I claim as my invention:

1. An escalator comprising:

a truss, said truss including a portion having a longitudinal axis inclined with respect to a horizontal plane, a conveyor supported by said truss, a drive unit in said truss for driving said conveyor, said drive unit having X-, Y-, and Z-axes, with said X-axis being a longitudinal axis to be oriented parallel with the longitudinal axis of said truss, said Y-axis being perpendicular to said X-axis in a predetermined plane, and said Z-axis being perpendicular to the predetermined plane which includes the X- and Y-axes, first adjustment means for positionally adjusting said drive unit along its Z-axis, and also about its X- and Y- axes, second adjustment means for positionally adjusting said drive unit along its Y-axis, and also for positionally adjusting said drive unit about its Z-axis, and third adjustment means for positionally adjusting said drive unit along its X-axis, said third adjustment means having a single adjustment point, with said third adjustment means being capable of adjusting said drive unit along its X-axis without changing the associated positional adjustments selected by said first and second adjustment means.

2. The escalator of claim 1 wherein the first adjustment means includes at least two adjustment devices disposed on one side of the longitudinal axis of the drive unit, and at least two adjustment devices disposed on the other side, with the adjustment of at least two devices on any one side of the longitudinal axis providing adjustment about the X-axis, the adjustment of a selected device on each side of the longitudinal axis providing adjustment about the Y-axis, and the adjustment of all devices providing adjustment along the Z-axis.

3. The escalator of claim 1 wherein the second adjustment means includes at least one adjustment device on one side of the Y-axis, and at least one adjustment device on the other side, with the adjustment of either providing adjustment about the Z-axis, and the adjustment of both providing adjustment along the Y-axis.

4. The escalator of claim 1 wherein the drive unit includes a mounting base having front and back portions disposed transverse to the longitudinal axis of the truss, and first and second side portions disposed in the direction of the longitudinal axis of the truss, and wherein the single adjustment point of the third adjustment means includes a deflection beam member having first and second ends, a stud threadably engaged with said deflection beam member, means mounting the first and second ends of said deflection beam member to the first and second side portions, and means adjustably fixing said stud to said truss, such that at least a portion of the load forces applied to the drive unit are transmitted longitudinally through the first and second side portions to said deflection beam member.

5. An escalator, comprising:

a truss having a longitudinal axis, a drive unit in said truss, an elongated deflection member having first and second ends, and means mounting said deflection member between said drive unit and said truss, such that at least a portion of the load forces developed in the drive unit are transmitted from the drive unit to the first and second ends of the deflection member, and from substantially the midpoint of the deflection member to the truss.

6. The escalator of claim 5 wherein the drive unit includes a mounting base having elongated side portions oriented in the direction of the longitudinal axis of the truss, and elongated front and rear portions oriented transversely to the longitudinal axis, with at least a portion of the load forces of the drive unit being transmitted to the deflection member via the side portions of the mounting base.

7. The escalator of claim 5 wherein the drive unit includes a mounting base having first and second elongated side portions oriented in the direction of the longitudinal axis of the truss, and front and rear elongated portions oriented transversely to the longitudinal axis of the truss, and the deflection member is spaced from the front portion by first and second plate members respectively attached to the first and second side portions and the first and second ends of the deflection member.

8. The escalator of claim 5 wherein the means which transmits forces from the midpoint of the deflection member to the truss further includes means for adjusting the position of the drive unit relative to the truss.

* * * * *